US005400461A

United States Patent [19]

Malish et al.

[11] Patent Number: 5,400,461

[45] Date of Patent: Mar. 28, 1995

[54] LOCKING COUPLER FOR FLOOR MAINTENANCE PAD

[75] Inventors: Terrance J. Malish, Willoughby Hills; Kenneth L. Shary, Twinsburg; John D. Blazek, Willoughby, all of Ohio

[73] Assignee: Malish Brush and Specialty Company, Willoughby, Ohio

[21] Appl. No.: 184,392

[22] Filed: Jan. 21, 1994

Related U.S. Application Data

[63] Continuation-in-part of Ser. No. 996,275, Jan. 12, 1993, abandoned.

[51] Int. Cl.[6] ..... A47L 11/14; A47L 11/40

[52] U.S. Cl. ..... 15/230.17; 15/98; 15/230; 15/230.19; 403/348; 403/350; 411/508; 451/510

[58] Field of Search ..... 15/49.1, 50.1, 97.1, 15/98, 230, 230.17, 230.19, 246; 403/348, 350; 51/378, 379; 411/508

[56] References Cited

U.S. PATENT DOCUMENTS

| | | | |
|---|---|---|---|
| 2,521,257 | 9/1950 | Sample . | |
| 3,360,890 | 1/1968 | Dooley, Jr. | 51/378 |
| 3,436,876 | 4/1969 | McAvoy et al. | 51/378 |
| 3,462,889 | 8/1969 | Erickson | 51/380 |
| 3,757,378 | 9/1973 | Wakefield | 15/230.19 |
| 4,536,912 | 8/1985 | Malish | 15/230.17 |
| 4,541,207 | 9/1985 | Antonson | 51/376 |
| 4,637,170 | 1/1987 | Block | 51/378 |
| 4,655,006 | 4/1987 | Block | 51/378 |
| 4,662,024 | 5/1987 | Moench | 15/230.19 |
| 4,799,282 | 1/1989 | Fischer | 15/98 |
| 4,888,843 | 12/1989 | Smith et al. | 15/98 |
| 5,230,120 | 7/1993 | Ireson et al. | 15/98 |

FOREIGN PATENT DOCUMENTS

| | | | |
|---|---|---|---|
| 243130 | 2/1961 | Australia | 15/230.19 |

*Primary Examiner*—Edward L. Roberts, Jr.

*Attorney, Agent, or Firm*—Watts Hoffmann Fisher & Heinke

[57] ABSTRACT

A coupler is disclosed for coupling floor maintenance pads to a driven pad disc. The coupler has one part for mounting on the driven disc and a second part which threads to the first part for holding and centering a maintenance pad to a disc. A lock arrangement is provided for preventing the coupler from becoming unthreaded during operation. The locking arrangement is formed by a detent mechanism. One part of the detent mechanism is formed on the first part and another cooperating part of the detent mechanism is formed on the second part. When the coupler parts are threaded together to secure a pad, the detent mechanism engages and provides a resisting force against unthreading. In another embodiment, wedge-shaped projections are formed on one part of the coupler for engaging a pad and resisting loosening.

19 Claims, 7 Drawing Sheets

LOCKING COUPLER FOR FLOOR MAINTENANCE PAD

This is a continuation-in-part of U.S. patent application Ser. No. 07/996,275, filed on Jan. 12, 1993, now abandoned.

BACKGROUND OF THE INVENTION

1. Field Of the Invention

The present invention relates to apparatus for securing a pad to a rotary floor machine of the type used in floor maintenance, and more particularly, a locking coupler for securing a pad to a rotating driver disc of a floor maintenance machine.

2. Description of Related Art

Coupler devices are well known for centering and coupling a floor maintenance pad to a pad driver disc. The pad driver disc is rotated by the drive shaft of a power-driven floor maintenance machine. One example of such a coupling device is illustrated and described in U.S. Pat. No. 4,536,912. Pad coupler devices typically have two parts which have mating threads. The first part is fixed to the driver disc and the second part is threaded to the first part to hold the pad in a centered position on the disc. The second part may be readily uncoupled by unthreading to replace the pad. The pads are replaced frequently due to wear or to use a pad with different abrasive characteristics.

Couplers are usually provided with either left-handed or fight-handed threads depending on the direction of rotation of the pad driver disc. The thread direction is chosen such that the theoretical resultant torque on the coupler tends to tighten the threaded connection. That is, a machine, which rotates counterclockwise as viewed facing the working surface of the pad, is provided with a coupler having a right-handed thread causing the coupler, in theory, to self-tighten during operation.

Despite the self-tightening design, couplers sometimes loosen during floor maintenance operations. The cause of the loosening is unknown, but is thought to be due to vibrations. Thus, there is a need for a coupler which holds and centers the pad, is readily uncoupled for changing pads, and which does not loosen during use.

SUMMARY OF THE INVENTION

In its broad aspects, the invention embodies a coupling device for mounting a floor maintenance pad having a circular mounting hole to a drive disc on a power-driven floor maintenance machine. The coupling device includes a base mountable coaxially to the drive disc. The base has a threaded hub. A retainer having a threaded hub for threading coaxially onto the hub of the base member is provided. The retainer has a flange extending radially outward from the retainer hub for engaging in holding the pad against the disc. A detent mechanism is included. The detent mechanism has a projection formed on either the base or the retainer and an indentation cooperating with the projection formed on the other. The projection engages the indentation at a point during the rotation of the retainer with respect to the base as the two are being threaded together. When so engaged, the detent mechanism provides a resistance to rotation.

In one preferred construction, the indentation is formed on the threads of either the base or the retainer and the projection is formed on the threads of the other.

In preferred constructions, a plurality of indentations are formed on either the base or the retainer and the projection comes into alignment with each indentation at spaced intervals of rotation as the parts are threaded together.

In preferred constructions, the projection is formed on the end of an elastically flexible arm which acts to bias the projection toward the indentation.

In a second preferred embodiment, either the base or the retainer has a circular shoulder and the other has a circular collar which surrounds the shoulder when the pans are threaded together. An indentation is formed on the peripheral portion of the collar and the projection is formed on an inner surface of the collar.

In another preferred embodiment, the retainer has a number of wedge-shaped projections formed on a flange. The projections are arranged to engage with the pad when the coupler is threaded together and to resist unthreading of the coupler.

BRIEF DESCRIPTION OF THE DRAWINGS

Preferred embodiments are shown in the accompanying drawings in which.

DESCRIPTION OF THE PREFERRED EMBODIMENTS

Figure 1:
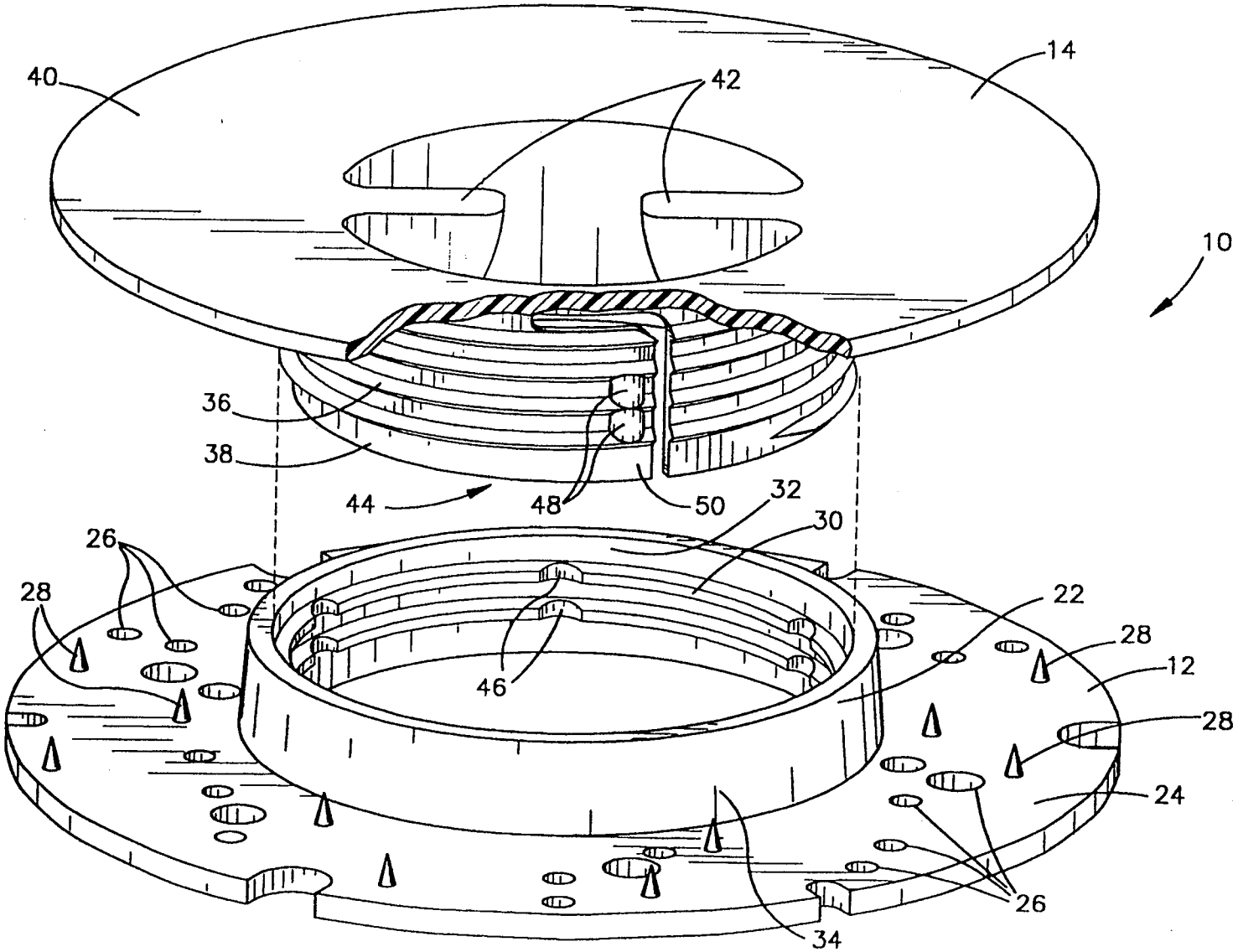
FIG. 1 is an exploded perspective view of a coupler of the present invention.
Figure 2:
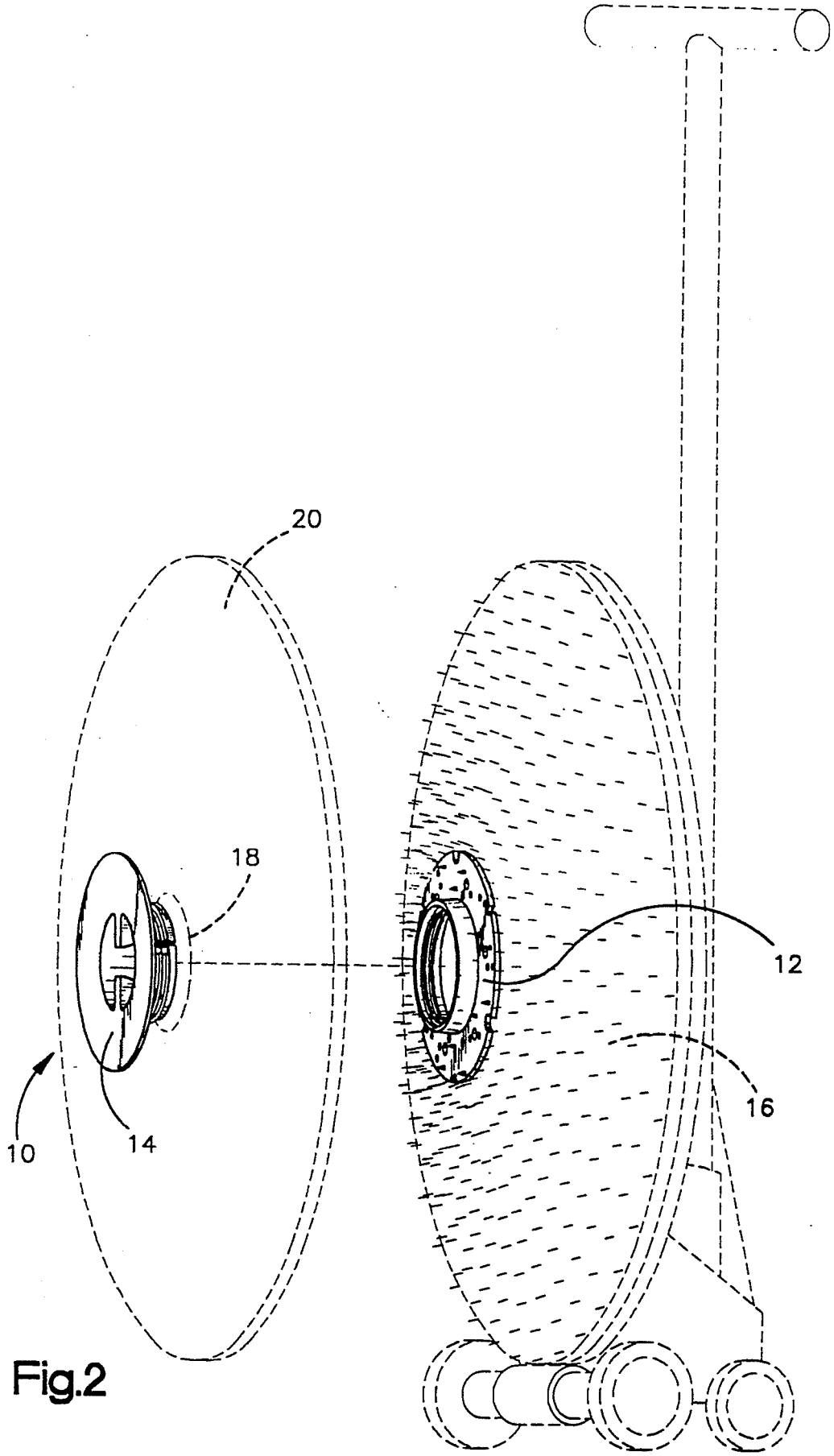
FIG. 2 is an exploded perspective view of a coupler mounted to a floor maintenance machine.

Referring to FIG. 1, a coupler 10 is shown which has a base 12 and a retainer 14. As seen in FIG. 2, the base 12 is coaxially attached to a pad driver disc 16. The retainer 14 fits within a circular mounting hole 18 of a floor maintenance pad 20 and threads onto the base 12.

The coupler 10 centers and holds the pad 20 to the disc 16 when in its coupled state. In the machine illustrated in FIG. 2, the pad driver 16 engages the upper surface of the pad 20 with a plurality of bristles for spinning the pad for a variety of floor maintenance operations such as polishing, burnishing, scrubbing and stripping. Each separate task requires a pad 20 with particular abrasive characteristics. Thus, the retainer 14 is readily uncoupled from the base 12 by unthreading to permit an operator to replace the pad 20.

The base 12 has a hub 22 and a flange 24 extending radially outward from one end of the hub 22. The flange has a plurality of screw holes 26 formed in its surface for attaching the base to the driver disc 16 with screws. Numerous holes 26 are provided in various patterns to make the base 12 compatible with all conventional types of pad drivers 16. A plurality of tines 28 are formed on the side of the flange 24 facing away from the driver disc 16. The tines 28 project in the axial direction of the hub 22 and are for piercing the pad 20 for holding it in position. The tines 28 serve to prevent the pad 20 from outward stretching during high speed operation due to the influence of centrifugal force. While provision of the base flange 24 is preferred, the base 12 may be simply a threaded ring without a flange fixed to the disc 16.

The hub 22 has a threaded opening 32 surrounded by a tapered wall 34. The tapered wall 34 forms a ring which serves to center the pad 20 on the disc 16 and accommodate size variations in the center mounting hole 18. Threads 30 are formed in the inside of the wall 34 for engaging cooperating threads 36 formed on the retainer 14. The large central opening 32 permits access with a wrench to the center of the driver disc 16 where there is often a nut for holding the disc 16 to the drive shaft (not shown) of the floor maintenance machine. Some floor maintenance machines are equipped with fluid dispensers. The large central opening 32 also permits fluid to flow from such a dispenser to the floor below.

The retainer 14 has a hub 38 and a flange 40. The hub 38 has outer threads 36 for coaxially engaging the cooperating threads 30 on the base 12. The hub 38 is made with a predetermined length such that the threads engage before the pad is compressed by the flange 40. This way, it is easier to manually start the threads 30, 36 into proper engagement. At one end of the hub 38 is a pair of finger grip tabs 42 to facilitate manual rotation of the retainer 14. The flange 40 extends radially outward from one end of the hub 38 and has a relatively large surface area for holding the pad 20 against the opposed flange 24.

The coupler 10 is provided with a detent mechanism 44 for resisting rotation of the retainer 14 with respect to the base 12 to prevent loosening of the retainer 14 during operation. The detent mechanism 44 includes a plurality of indentations 46 formed in the base 12 and one or more cooperating projections 48 formed on the retainer 14. At spaced intervals of rotation of the retainer 14 with respect to the base 12 when the threads 30,36 are engaged, the projections 48 align with and engage each one of the indentations 46. When such engagement occurs, the detent mechanism 44 resists, but does not prevent, further rotation of the retainer 14.

Figure 3:
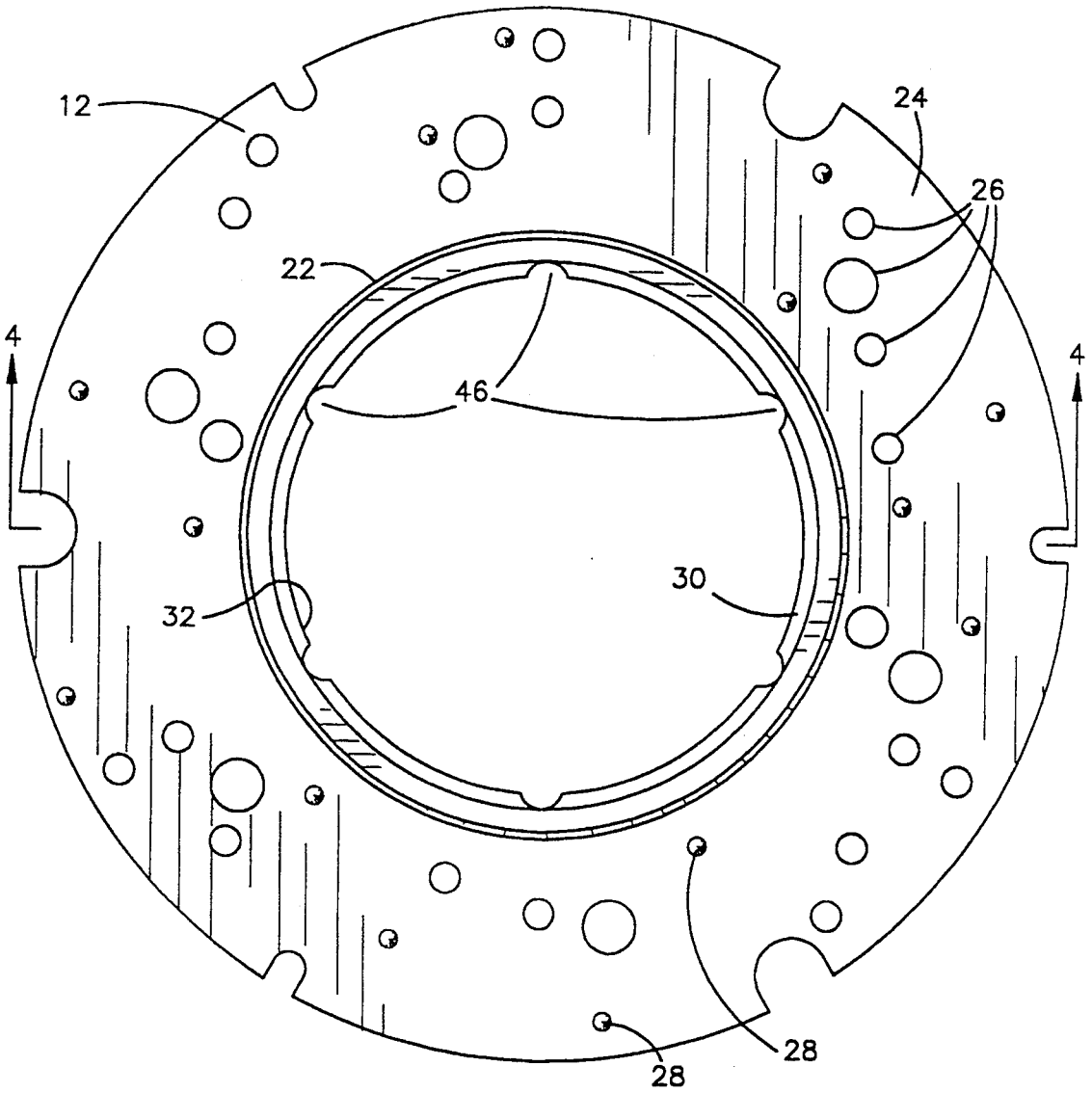
FIG. 3 is a top plan view of a base of the coupler of FIG. 1.
Figure 4:
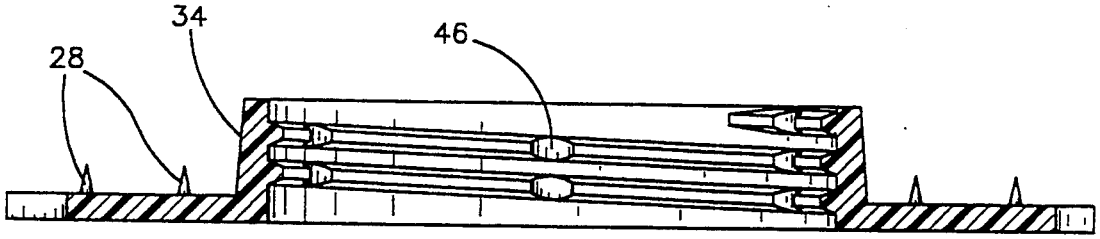
FIG. 4 is a cross sectional view of the base of FIG. 3 as seen approximately from the plane indicated by the line 4—4 in FIG. 3.

The indentations 46 are preferably semi-circular notches. As shown in FIGS. 1 and 3, the indentations 46 are formed on the threads 30 at spaced radial positions about the inside of the hub 22. As seen in FIG. 1, pairs of indentations 46 are axially aligned.

Figure 5:
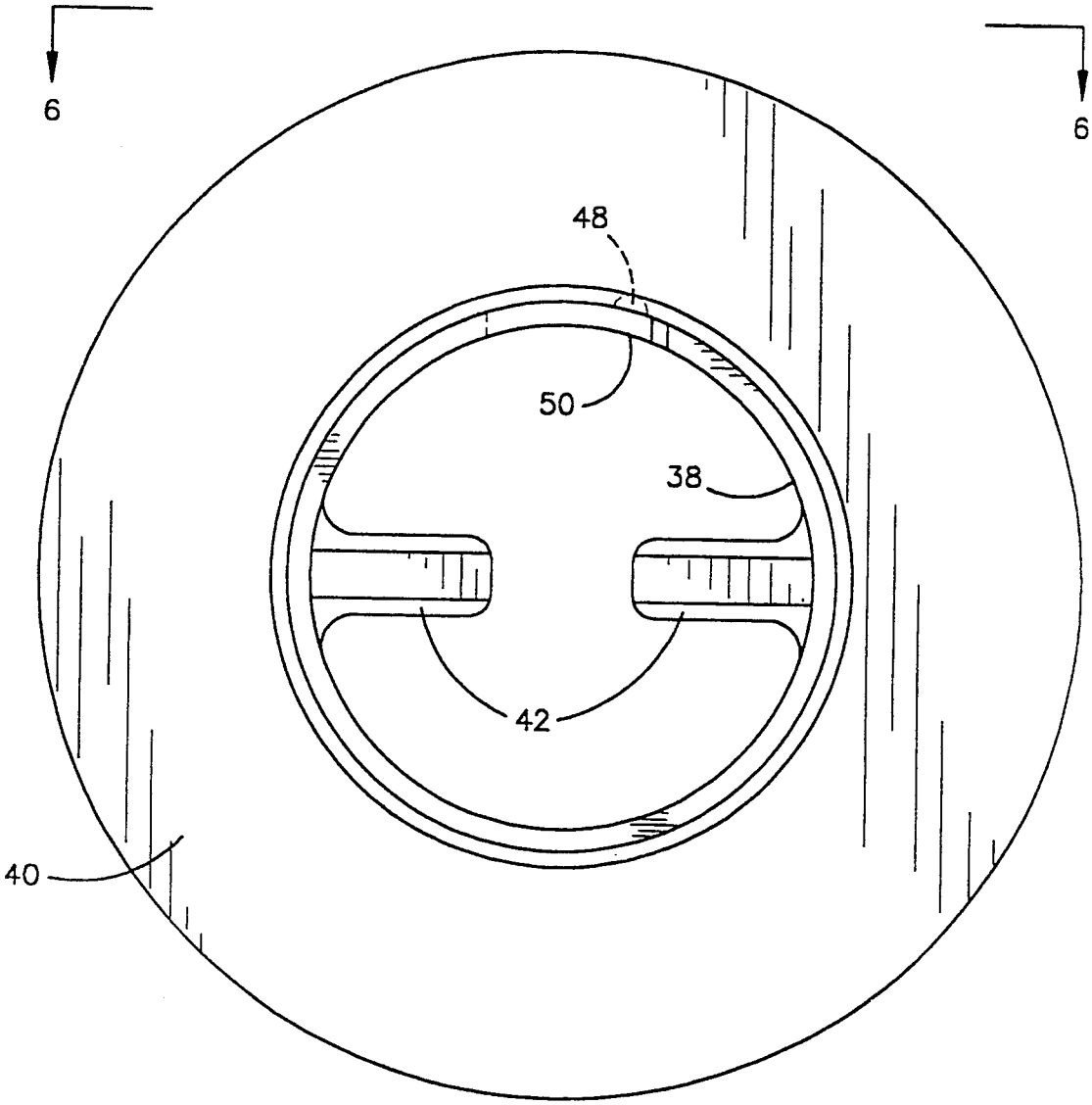
FIG. 5 is a bottom plan view of a retainer of the coupler of FIG. 1.
Figure 6:
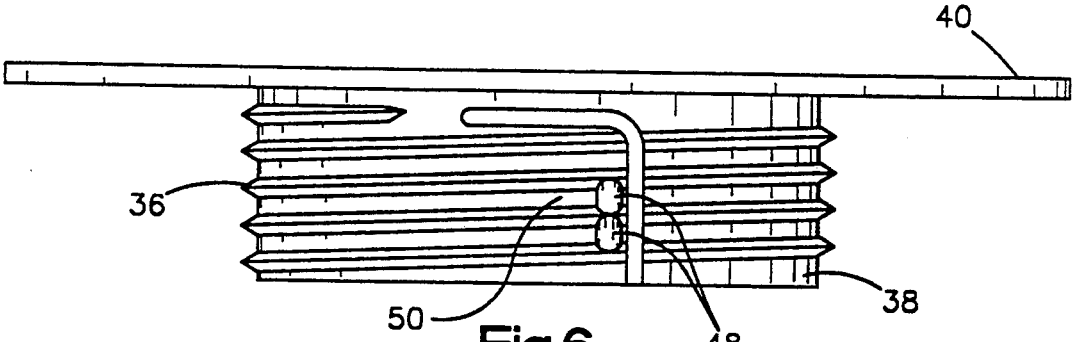
FIG. 6 is a side elevation view of the retainer of FIG. 5 as seen approximately from the plane indicated by the line 6—6 in FIG. 5.

The projections 48 are preferably semi-circular bulges sized to fit within the indentations 46. As seen in FIGS. 1, 5 and 6, the projections 48 are formed in the valleys of the threads 36 such that they will align with and engage the indentations 46 at various points during the threading motion of the threads 30, 36. In the preferred and illustrated embodiment of FIGS. 1–6, two projections 48 are provided, each of which simultaneously engages a separate indentation 46 when alignment with a pair of indentations 46 occurs.

A resiliantly flexible spring arm 50 is provided for biasing the projections 48 toward the indentations 46. As seen in FIGS. 1 and 6, a part of the hub 38 has been removed, leaving the arm 50 unsupported at one end in cantilever fashion. The coupler material, which is preferably ABS polymer, permits the arm 50 to elastically flex in the manner of a spring. The threads 36 which engage the projections 48, cause the arm 50 to elastically flex inward until a pair of indentations 46 aligns with projections 48 at which time the arm 50 returns outward, thus seating the projections 48 in the corresponding indentations 46. Further rotation of the retainer 14 with respect to the base 12 requires enough force to flex the arm 50 inward, thus unseating the projection 48 and creating a resistance to rotation. The resistance is not so great that an operator cannot manually rotate the retainer 14. It has been found that the detent mechanism 44 prevents the coupler 10 from loosening or unthreading during use.

While the preferred and illustrated embodiment has indentations 46 formed in the base part 12 and a projection 48 formed in the retainer part 14, this arrangement may be reversed such that the indentations 46 are formed on the retainer part 14 and the projection 48 is formed on the base part 12. In addition, the indentations 46 and projection 48 need not be formed on the threaded portions of the coupler 10. That is, the indentations 46 (or projection 48) may be formed on the flange 40 and the projection 48 (or indentations 46) may be formed on a portion of the hub 22 such that the indentations 46 and the projection 48 cooperate when the coupler parts 12, 14 are threaded together.

Figure 7:
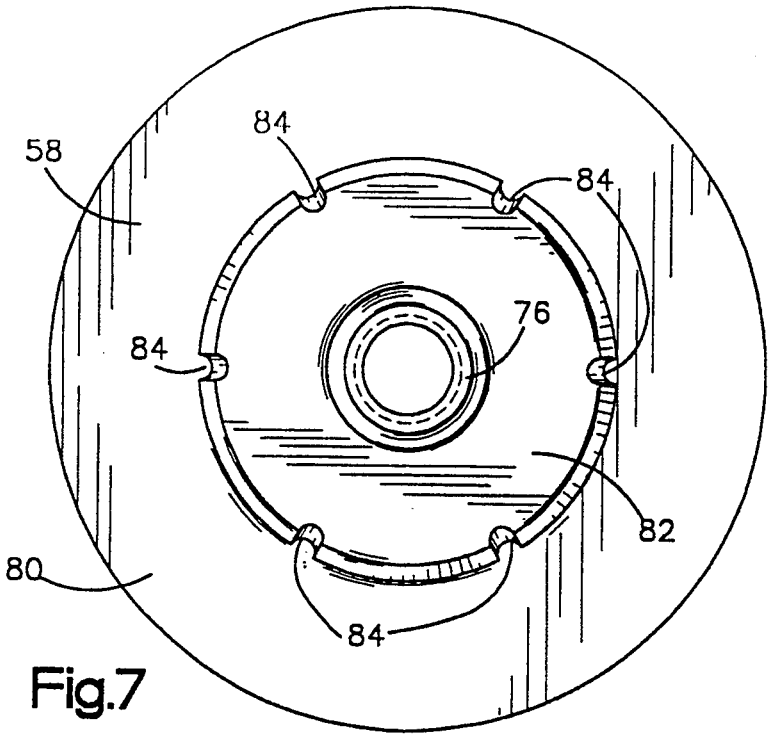
FIG. 7 is a top plan view of a retainer of a second embodiment of the coupler.
Figure 8:
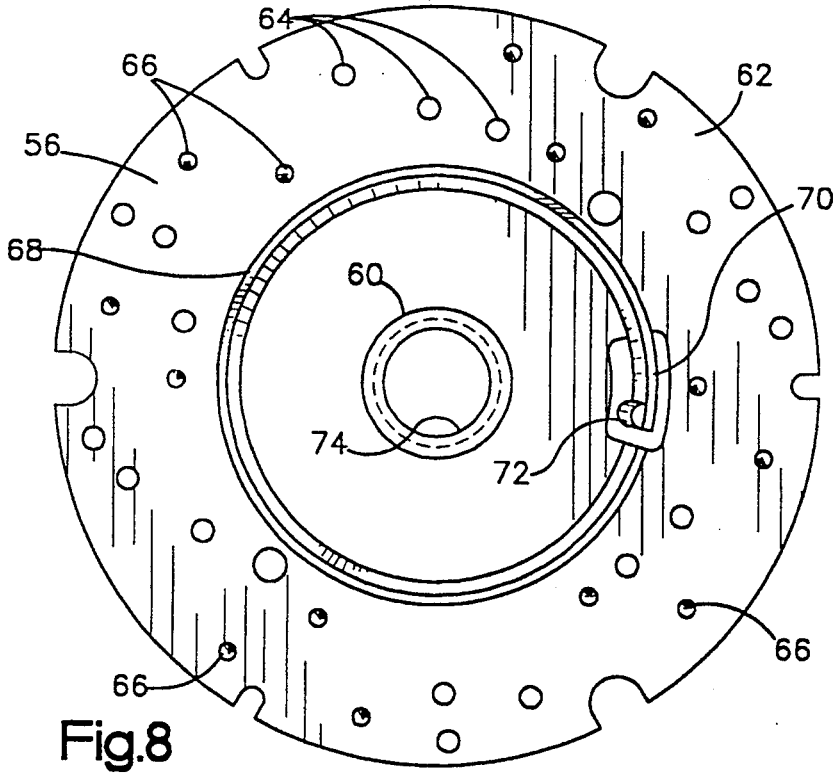
FIG. 8 is a top plan view of a base of the second embodiment of the coupler.
Figure 9:
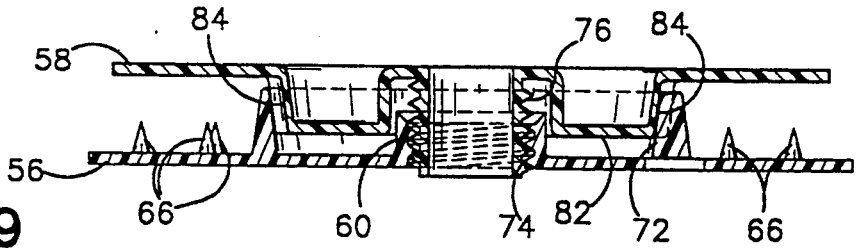
FIG. 9 is a cross sectional view of the second embodiment of the coupler with the base of FIG. 8 joined to the retainer of FIG. 7.

In a second preferred embodiment seen in FIGS. 7 and 8, a coupler has a base 56 and a retainer 58. The coupler of FIGS. 7 and 8 functions like the previously described coupler 10 to secure a pad to a drive disc 16. The base 56 has a hub 60 and a flange 62 extending radially outward from one of the hub 60. The flange includes mounting holes 64 and tines 66 in an arrangement similar to the previously described flange 24. A ring 68 is formed on the flange 62 and extends normally from the plane of the flange 62. The inner wall of the ring 68 is tapered such that the inner diameter of the ring 68 gets larger as the distance from the flange 62 increases. The hub 60 includes a threaded opening 74 for receiving a cooperating threaded spindle 76 of the retainer 58.

The ring 68 is split at one point, and a portion of the flange material beneath the ring is removed to provide a resiliantly flexible spring arm 70 supported at only one end. A projection 72 is formed at the unsupported end of the spring arm 70. The projection 72 is shaped in a semi-circular bulge like the projections 48 described previously.

The retainer 58 includes a flange 80, a circular shoulder portion 82 and the threaded spindle 76. The flange 80 serves to hold a pad 20 just like the flange 40 described previously. The circular shoulder portion 82 is tapered such that it has a reduced diameter further from the flange 80. A plurality of indentations 84 are provided at spaced intervals about the periphery of the shoulder 82. The indentations are semi-circular notches similar to the indentations 46 described earlier.

To employ the coupler of FIGS. 7 and 8, the base 56 is attached to the driver disc 16. The retainer 58 is then placed through the center hole 18 of a pad 20. Then, the retainer is threaded onto the base 56 by engaging the threaded spindle 76 with the threaded opening 74. As the retainer 58 moves toward the base 56, the flange 80 serves to clamp the pad 20 against the ring 68 and the flange 62. At spaced intervals of rotation of the retainer 58 with respect to the base 56, the projection 72 seats within each indentation 84, thus causing resistance to rotation. The spring arm 70 flexes elastically outward when the projection is disengaged with an indentation 84 and returns inward upon alignment with an indentation 84.

Figure 10:
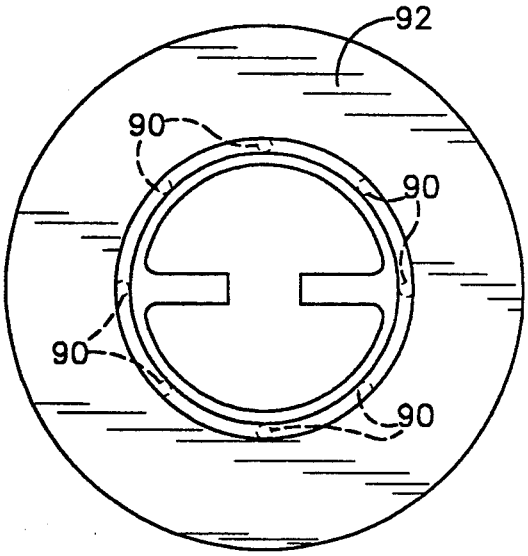
FIG. 10 is a plan view of a threaded side of a retainer of a third embodiment of the coupler.
Figure 11:
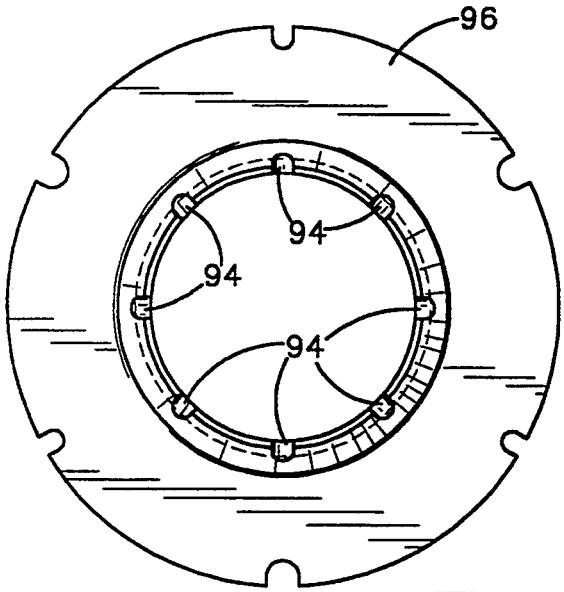
FIG. 11 is a plan view of a base of the third embodiment.
Figure 12:
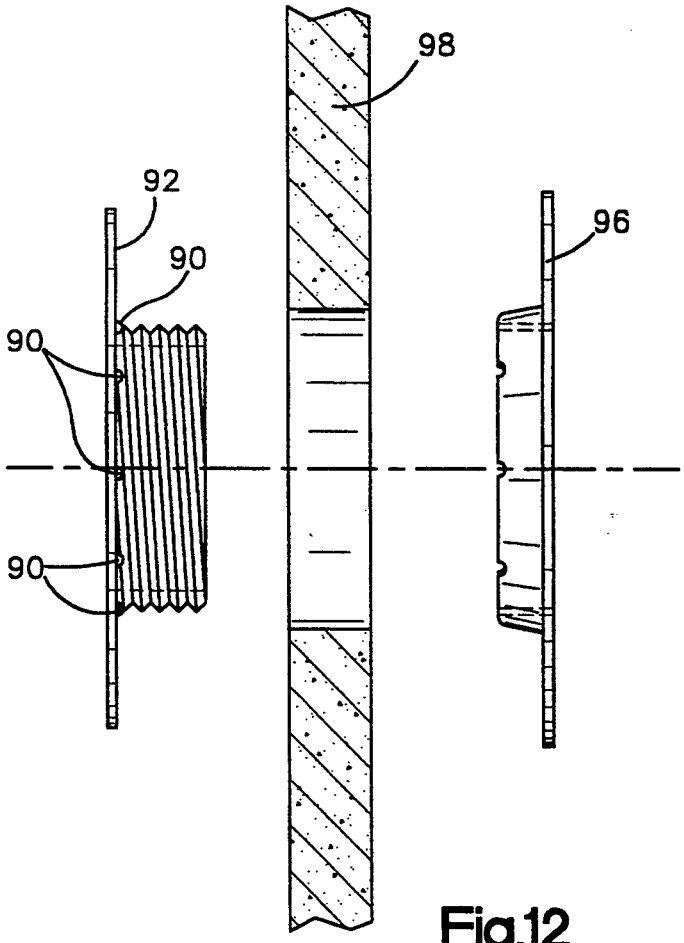
FIG. 12 is an exploded side view of the third embodiment of FIGS. 10 and 11 with parts omitted and broken away.

FIGS. 10–12 illustrate a third coupler embodiment where a number of projections 90 are formed on a threaded retainer part 92. A number of corresponding indentations 94 are formed on a threaded base part 96. When the retainer part 92 is nearly fully threaded to the base part 96, the projections 90 will engage the indentations 94 and resist unthreading of the coupler. Thus, the retainer 92 holds a pad 98 to a rotating disk of a floor treatment machine without undesired loosening.

Figure 13:
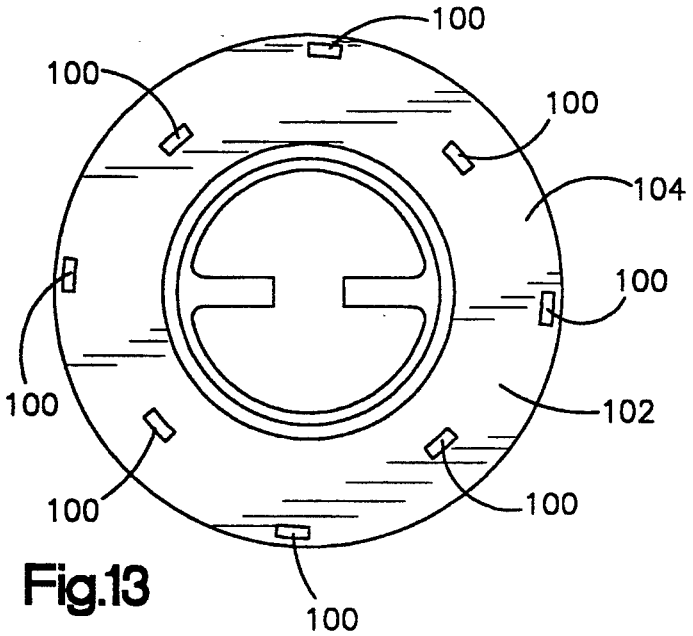
FIG. 13 is a plan view of a retainer of a fourth embodiment of the coupler.
Figure 14:
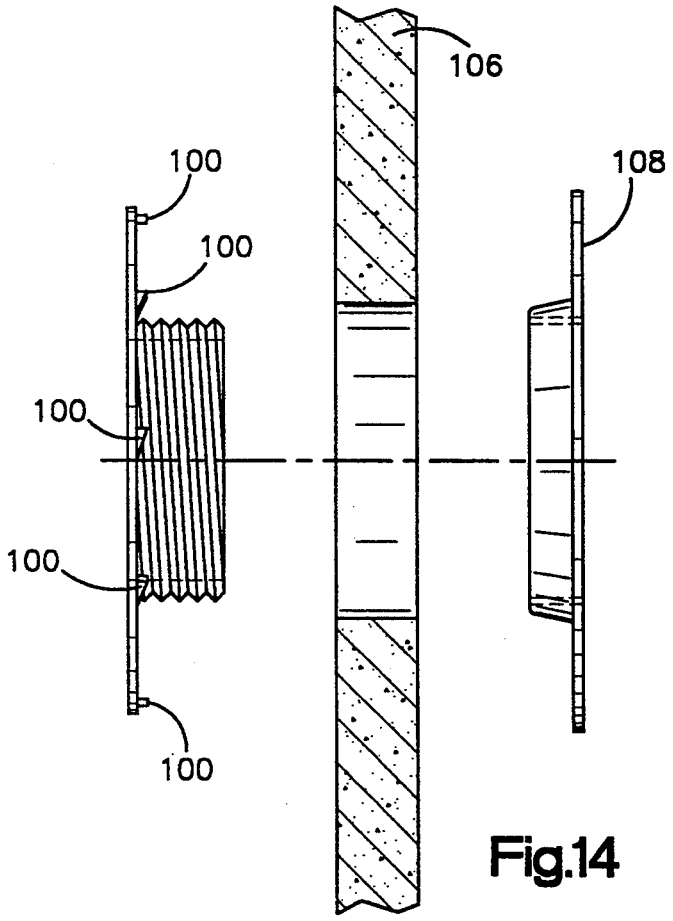
FIG. 14 is an exploded side view of the fourth embodiment with parts omitted and broken away.
Figure 15:
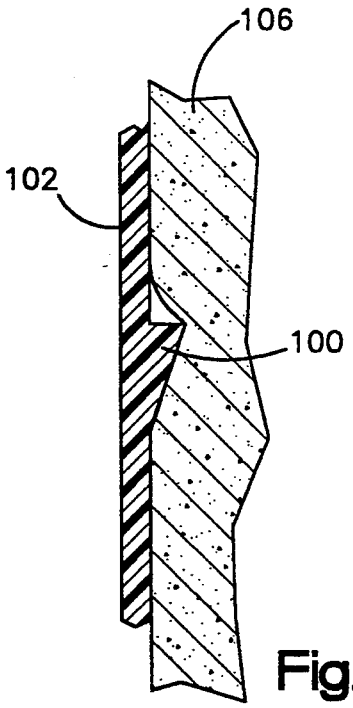
FIG. 15 is an enlarged partial section view of the coupler of the fourth embodiment.

FIGS. 13–15 illustrate a fourth coupler embodiment where a number of wedge-shaped projections 100 are formed on one side of a flange 102 of a threaded retainer 104. As shown in FIG. 14, the wedge-shaped projections 100 face a pad 106. When the retainer 104 is threaded to a corresponding base part 108, the projections 100 engage the pad 106. The wedge-shaped projections 100 are arranged to provide resistance to rotation of the retainer 104 in the direction of unthreading. The projections create less resistance in the threading direction. FIG. 15 shows one projection 100 in engagement with the pad 106. Movement of the retainer 104 in the downward or threading direction of FIG. 15 requires less force than movement in the opposite direction due to the position of the slope of the wedge-shaped projection 100. Thus, the retainer 104 holds the pad 106 against a rotating disk of a floor treatment machine without undesired loosening.

In another embodiment of the coupler (not shown), a detent mechanism is formed by a tab or lever extending from a gearbox of the floor cleaning machine through the center opening of a base part. The tab or lever rotates with the rotating disc 16. The tab or lever has a projection (or indentation) for engaging an indentation (or projection) on a retainer part when it is threaded to the corresponding base part. Thus, in a manner similar to that described with respect to the embodiments of FIGS. 1–12, the retainer resists rotation and undesired loosening.

While preferred embodiments of this invention have been described in detail, it will be apparent that certain modifications or alterations can be made without departing from the spirit and scope of the invention set forth in the appended claims.

We claim:

1. A coupling device for mounting a floor maintenance pad having a circular mounting hole to a drive disc on a power: driven floor maintenance machine, said coupling device comprising: a base part mountable coaxially to the drive disc and having a threaded hub;

a retainer part having a threaded hub for threading coaxially onto the hub of said base member, said retainer having a flange extending radially outward from said retainer hub for engaging and holding said pad against said disc;

a detent mechanism including a projection formed on one of said base pan and said retainer part and an indentation cooperating with said projection formed on the other, wherein said projection engages said indentation at a point during the rotation of the retainer part with respect to the base part as the two are being threaded together and, when so engaged, provides a resistance to such rotation.

2. A coupling device according to claim 1 wherein said indentation is formed on the threads of one of said base part and said retainer part and said projection is formed on the threads of the other.

3. The coupling device according to claim 1 wherein said indentation is formed on the hub of one of said pans and the projection is formed on the hub of the other part.

4. The coupling device of claim 1 wherein a plurality of indentations are formed on one of said parts and wherein said projection comes into alignment with each one of said indentations at spaced intervals of rotation as the parts are threaded together.

5. The coupling device according to claim 1 wherein said projection is formed on the end of an elastically flexible arm which acts to bias said projection towards said indentation.

6. The coupling device according to claim 1 wherein a portion of the hub of one of said pans is cut away such that a flexible arm is formed and wherein one of said indentation and said projection is formed on said arm and the other is formed on the hub of the other of said pans such that said projection and said indentation are biased toward one another.

7. The coupling device of claim 1 wherein one of said pans comprises a circular shoulder and the other of said parts comprises a collar which surrounds said shoulder when said parts are threaded together, and wherein said indentation is formed in a peripheral portion of said shoulder and said projection is formed in an inner portion of said collar.

8. The coupling device of claim 1 wherein said base part has a plurality of tines projecting in the axial direction of said hub for piercing said pad.

9. The coupling device of claim 1 wherein a plurality of indentations are formed on one of said pans and wherein said projection comes into alignment with each one of said indentations at spaced intervals of rotation as the pans are threaded together.

10. A coupling device for detachably mounting a floor maintenance pad having a circular mounting hole on a pad holder disc of a floor maintenance machine, said coupler device comprising:

a first part having a threaded hub and a flange portion extending radially outward from said hub, said flange being adapted to attach to said pad holder member;

a second part having a threaded hub adapted to thread to the hub of said first pan and a flange portion extending radially outward from said hub of said second pan, wherein a floor maintenance pad is held between the flange of the first part and the flange of the second pan when said parts are threaded together;

a detent mechanism for resisting rotation between said first and second pans, said mechanism including at least one indentation formed on one of said pans and a projection formed on the other of said parts, wherein said projection comes into alignment with said indentation at a point during the rotation of said parts when said pans are threaded together and engages said indentation at said point.

11. The coupling device according to claim 10 wherein said indentation is formed on the hub of one of said parts and the projection is formed on the hub of the other part.

12. The coupling device according to claim 11 wherein a portion of the hub of one of said pans is cut away such that a flexible arm is formed and wherein one of said indentation and said projection is formed on said arm and the other is formed on the hub of the other of said parts such that said projection and said indentation are biased toward one another.

13. The coupling device according to claim 11 wherein said projection is formed on the end of an elastically flexible arm which acts to bias said projection towards said indentation.

14. The coupling device of claim 11 wherein one of said parts comprises a circular shoulder and the other of said parts comprises a collar which surrounds said shoulder when said parts are threaded together, and wherein said indentation is formed in a peripheral portion of said shoulder and said projection is formed in an inner portion of said collar.

15. The coupling device of claim 11 wherein said base part has a plurality of tines projecting in the axial direction of said hub for piercing said pad.

16. The coupling device of claim 11 wherein a plurality of indentations are formed on one of said pans and wherein said projection comes into alignment with each one of said indentations at spaced intervals of rotation as the parts are threaded together.

17. The coupling device of claim 11 wherein said indentation is formed on the threads of one of said parts and said projection is formed on the threads of the other part.

18. A coupling device for detachably mounting a floor maintenance pad having a circular mounting hole on a pad holder disc of a floor maintenance machine, said coupler device comprising:

a first part having a threaded hub and a flange portion extending radially outward from said hub, said flange being adapted to attach to said pad holder member and having a plurality of tines extending in the axial direction of said hub away from said disc for piercing and holding said pad;

a second part having a threaded hub adapted to thread to the hub of said first part and a flange portion extending radially outward from said hub of said second part, wherein a floor maintenance pad is held between the flange of the first part and the flange of the second part when said parts are threaded together;

a detent mechanism for resisting rotation between said first and second parts, said mechanism including a plurality of indentations formed on one of said parts and a flexible arm having a projection at its end formed on the other of said parts, wherein said projection comes into alignment with each of said indentations at spaced points during the rotation of said parts with respect to one another when said parts are threaded together and engages said indentation at said points.

19. A coupling device for mounting a floor maintenance pad having a circular mounting hole to a drive disc on a power driven floor maintenance machine, said coupling device comprising:

a base part mountable coaxially to the drive disc and having a threaded hub;

a retainer part having a threaded hub for threading coaxially onto the hub of said base member, said retainer having a flange extending radially outward from said retainer hub for engaging and holding said pad against said disc;

a detent mechanism including a projection and a cooperating indentation wherein one of said projection and indentation is connected to said floor maintenance machine to rotate with said drive disc and the other is formed on the retainer part such that said projection engages said indentation at a point during the rotation of the retainer part with respect to the base part as the two are being threaded together and, when so engaged, provides resistance to unthreading of the coupling device.

* * * * *